US006173909B1

(12) United States Patent
Sprakel et al.

(10) Patent No.: US 6,173,909 B1
(45) Date of Patent: Jan. 16, 2001

(54) PORTABLE FIRE EXTINGUISHING NOZZLE ARRANGEMENT

(75) Inventors: Dirk Sprakel, Odenthal-Altenberg; Jan Sprakel, Burscheid, both of (DE); Jesper Lindenberg Olesen, Svenstrup gedthab (DK)

(73) Assignee: Kamat-Pumpen GmbH & Co. KG, Witten-Annen (DE)

( * ) Notice: Under 35 U.S.C. 154(b), the term of this patent shall be extended for 0 days.

(21) Appl. No.: 08/945,569

(22) PCT Filed: Apr. 18, 1996

(86) PCT No.: PCT/EP96/01622

§ 371 Date: Feb. 6, 1998

§ 102(e) Date: Feb. 6, 1998

(87) PCT Pub. No.: WO96/33774

PCT Pub. Date: Oct. 31, 1996

(30) Foreign Application Priority Data

Apr. 22, 1995 (DE) ..... 195 14 939
Nov. 29, 1995 (DE) ..... 295 18 911 U

(51) Int. Cl.[7] ..... B05B 1/16
(52) U.S. Cl. ..... 239/444; 239/559
(58) Field of Search ..... 239/444–449, 239/558, 559

(56) References Cited

U.S. PATENT DOCUMENTS

| | | | | |
|---|---|---|---|---|
| 195,643 | * | 9/1877 | Shoop | 239/449 |
| 236,541 | * | 1/1881 | Broughton | 239/449 |
| 2,359,455 | * | 10/1944 | Williamson | 239/449 |
| 2,364,848 | * | 12/1944 | Hurst | 239/444 |
| 2,567,176 | * | 9/1951 | Ballard | 239/449 |
| 4,828,178 | * | 5/1989 | Tucker et al. | 239/559 |
| 5,551,637 | * | 9/1996 | Lo | 239/449 |
| 5,816,505 | * | 10/1998 | Tran et al. | 239/449 X |

FOREIGN PATENT DOCUMENTS

| | | |
|---|---|---|
| 3822 160 A1 | 1/1990 | (DE) . |
| WO 92/20453 | 11/1992 | (WO) . |
| WO 94/06517 | 3/1994 | (WO) . |

* cited by examiner

*Primary Examiner*—Kevin Weldon

(57) ABSTRACT

A portable fire extinguishing nozzle arrangement has a nozzle head provided with fire extinguishing nozzles that may be connected to a supply pipe. A plurality of fire extinguishing nozzles are mutually spaced apart at the free front side of the nozzle head. When supplied with fire extinguishing fluid, each fire extinguishing nozzle generates a mist of fire extinguishing fluid. The fire extinguishing nozzles may be selectively supplied with fire extinguishing fluid individually and/or in groups through a valve combination.

13 Claims, 2 Drawing Sheets

PORTABLE FIRE EXTINGUISHING NOZZLE ARRANGEMENT

BACKGROUND OF THE INVENTION

The present invention relates to a transportable fire extinguishing pistol comprising a fire extinguishing nozzle-head fitted with fire extinguishing nozzles, in which the fire extinguishing nozzles are connectable to a supply pipe. Such fire extinguishing pistols are used in stationary or mobile fire extinguishing systems in which the extinguishing fluid is sprayed onto the seat of the fire by way of a fire extinguishing nozzle.

Fire extinguishing pistol of the type mentioned in the introduction is know from U.S. Pat. No. 3,704,831. With the known pistol, the nozzle head is rotatably arranged in such a way that by turning the head, the nozzle apertures arranged on the face can be brought into alignment with the outlet aperture of a fire extinguishing fluid supply-pipe. In this way, a fire extinguishing jet emanates from one of the nozzles.

In the case of the known fire extinguishing pistol, the extinguishing fluid emanates with relatively high kinetic energy. The advantage of using such an extinguishing fluid jet consists of the possibly of targeting the jet of extinguishing substance to the area of the fire covering a considerable range. In this way, among other things, the member of the fire brigade who operates the fire extinguishing plant is only exposed to a low risk of injury. In order to achieve this, in the past the water damage caused by the large quantities of extinguishing substance always required during firefighting was accepted as being inevitable.

Apart from the know fire extinguishing pistol mentioned above, from the international application WO94/25112, a fire extinguishing nozzle retainer, which is to be attached in a stationary manner, is known, in which the fire extinguishing nozzles are arranged on a bevelled, conically shaped exterior surface. The advantage of such a design of the fire extinguishing nozzle-holder consists in the ability to cover a relatively large volume of space with extinguishing fluid in short time by way of the fire extinguishing nozzles.

Apart from the traditional extinguished methods in which large quantities of extinguishing fluid are directed to the seat of the fire, it is known to use a fluid mist for extinguishing fires. By spraying such a fluid mist into the surroundings of the seat of the fire, the temperature of the gasses surrounding the seat of the fire is reduced. At the same time, the oxygen required for combustion is displaced from the surroundings of the fire. By reducing the temperature and displacing the oxygen, the fire is finally suffocated. A further particular advantage of extinguishing fires with a fluid mist consists of the fluid quantities required for extinguishing the fire being only small.

SUMMARY OF THE INVENTION

It is the object of the present invention to improve a fire extinguishing pistol of the type discribed in the introduction to such an extent that due to increased effectiveness of the fluid mist, the fluid quantity required to extinguish a fire is reduced.

According to the invention, this object is met in that with a fire extinguishing pistol of the type mentioned in the introduction, at the free front of the fire extinguishing nozzle-head a plural number of fire extinguishing nozzles are arranged, spaced apart in relation to each other, of which each one, when supplied with an extinguishing fluid under pressure, generates an extinguishing fluid mist; and that the extinguishing nozzles can be supplied with extinguishing fluid under pressure by way of a valve combination, as desired either individually and/or in groups.

Instead of or in addition to a central main nozzle, the invention provides for the provision of further fire extinguishing nozzles which generate a finely distributed extinguishing mist. It is possible to generate an extinguishing mist of a particular quality by selecting the individual fire extinguishing nozzles of which each one, depending on the case of application, for example can generate mist of a different type and composition; their number; their respective mode of operation; the type of supply with extinguishing fluid under pressure; and their positioning on the fire extinguishing nozzle-head. Among other things, this extinguishing mist is optimally composed with regard to the type and size of individual mist droplets contained in it.

In addition, the fire extinguishing pistol according to the invention makes it possible, during the firefighting operation, to adapt the type and composition of the extinguishing mist generated to the changing requirements as a result of progressive extinguishing success. This is achieved in that the fire extinguishing nozzles of the fire extinguishing nozzle-head can be supplied with extinguishing fluid under pressure either individually and/or in groups. In this way it is possible for example to use various fire extinguishing nozzle combinations for generating an extinguishing mist composed of a wide spectrum of different fluid droplets. Equally, for example with a view to cooling down the room temperature at the beginning of firefighting as quickly as possible, it is possible to generate an extinguishing mist which is composed of only a single, paricularly finely distrubuted, form of droplets. With progressing extinguishing success, this fine mist can then be supplemented with larger droplets by opening additional nozzles; for example for directly fighting smouldering fires.

Depending on the case of application, the individual fire extinguishing nozzles can be arranged in a line beside each other. This can be advantageous for those cases where uniform issue of extinguishing mist is desired over a large area. In addition, or alternatively, the nozzles can also be arranged on the circumferential line of an arc or in a complete circle.

In the case where, apart from the fire extinguishing nozzles arranged on the front, an additional main nozzle is provided from which substantial quantities of extnguishing substance can be applied if required, it is advantageous if the centre of the circle or the arc on which the nozzles are arranged, is arranged in the centre of this centrally-arranged main nozzle. Even distrubution of the extinguishing mist is also attained in that the individual nozzles are spaced apart with equal distance in respect to each other.

An advantageous embodiment in view of simple maintenance of the fire extinguishing pistol is characterised in that the fire extinguishing nozzle-head is detachably attached to a carrier unit.

Quick distribution of the extinguishing mist in a space as large as possible can be aided in that at least a certain number of fire extinguishing nozzles are arranged on a backward-slanting planar section of the face of the fire extinguishing nozzle-head. The speed with which a space volume can be filled can further be increased in that the fire extinguishing nozzle-head comprises a lateral area on which at least one additional fire extinguishing nozzle is arranged.

Further advantageous embodiments of the invention can be seen from the claims and the subsequent exemplary description below, where the invention is illustrated in more detail by means of a drawing showing one embodiment, in which like reference numerals designate the same elements:

DETAILED DESCRIPTION OF THE PREFERRED EMBODIMENT

Figure 1:
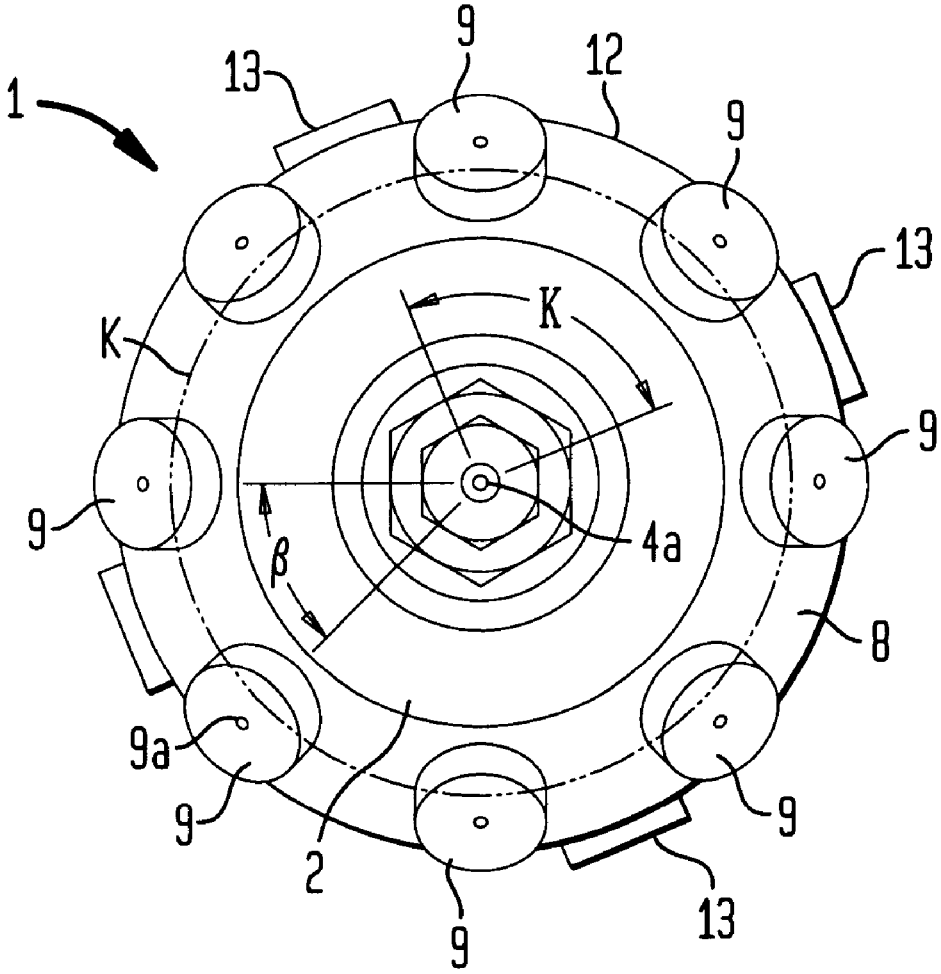
FIG. 1 is a front view of a fire extinguishing nozzle-head.
Figure 2:
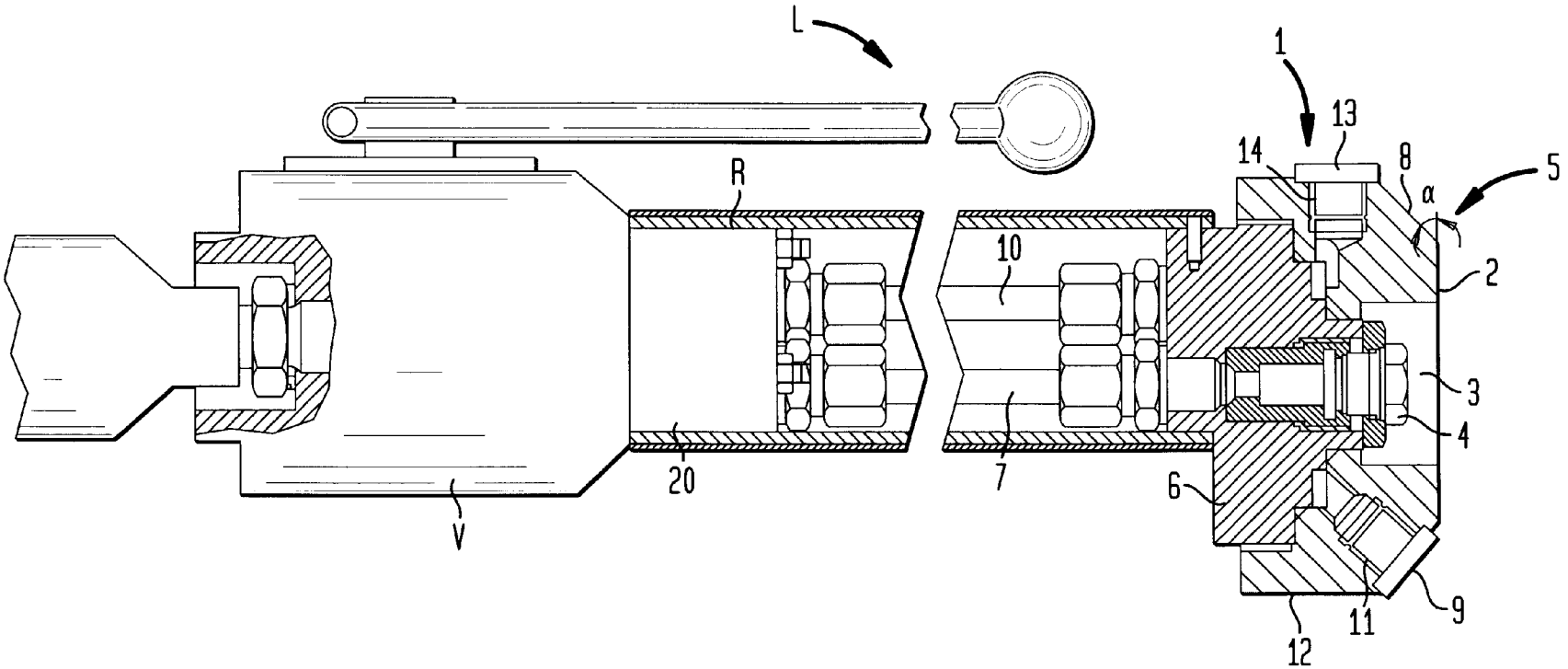
FIG. 2 is a partially exposed longitudinal section of a fire extinguishing pistol in accordance with the invention.

The transportable fire extinguishing pistol shown in FIG. 2 comprises a fire extinguishing nozzle-head 1 designed rotationally symmetrical, at the front S of which there is a face 2. At the centre of the face 2, a recess 3 is shaped which accommodates a central fire extinguishing nozzle 4. The central fire extinguishing nozzle 4 is screwed into a screw retainer 5 of a carrier unit 6 which is connected to a first supply pipe 7 and attached to the housing pipe R of the transportable fire extinguishing pistol L.

Shaped to the face 2 is α surrounding planar section 8, conical in shape, which recedes at an angle a in relation to the face 2. On the planar section 8, fire extinguishing nozzles 9 are arranged which are connected to a second supply pipe 10. The fire extinguishing nozzles 9 are arranged in regular angular spacing β in relation to each other in a circular K positioned concentrically to the aperture 4*a* of the central fire extinguishing nozzle 4. During pressurisation of the supply pipe 10, the fire extinguishing nozzles 9 generate an extinguishing mist in which the individual liquid droplets have a small volume and emanate in a finely distributed way from the nozzle aperture 9*a* of the fire extinguishing nozzles 9 into the surroundings of a seat of a fire.

In order to enable easy exchange of the fire extinguishing nozzles 9, the said nozzles are unscrewably screwed into screw retainers 11 which are connected to the second supply pipe 10.

A radially surrounding lateral area 12 joins the planar section 8 of the front S of the fire extinguishing nozzle-head 1. In the lateral area 12, further fire extinguishing nozzles 13 are arranged at regular angular spacing æ in respect to each other, which can be supplied under pressure by a third supply pipe (not shown). The fire extinguishing nozzle-heads 13 are also unscrewably seated in screw retainers 14; in the case of wear and tear they can simply be exchanged.

The fire extinguishing nozzles 9 can be supplied under pressure with extinguishing fluid together as a group, by way of the second supply pipe 10. Equally, the fire extinguishing nozzles 13 are supplied under pressure jointly as a group by way of the third supply pipe (not shown). This makes it possible to supply extinguishing fluid under pressure to the central fire extinguishing nozzle 4, the group consisting of the fire extinguishing nozzles 9 and the group consisting of the fire extinguishing nozzles 13, each of them independently.

Equally it is possible to operate the two groups of fire extinguishing nozzles 9, 13 and the central fire extinguishing nozzle 4 together in various combinations. In order to achieve this, a valve combination V, not described in any further detail, is provided. By way of a washer 20 comprising inclined bore holes, the outlet channels of the valve combination V, allocated to the two supply pipes 7, 10, and the third supply pipe (not shown) are connected to the supply pipe 7, 10 and the third supply pipe (not shown). By using the washer 20, it is possible to keep the valve housing of the valve combination simple in design, and at the same time to select the arrangement of the supply pipe 7, 10 and the third supply pipe in such a way that they take up as little space as possible.

What is claimed:

1. A transportable fire extinguishing pistol, comprising:

a housing;

a fire extinguishing nozzle-head attached to an end of the housing;

fire extinguishing nozzles mounted on said fire extinguishing nozzle-head in spaced apart positions at a forward end of the fire extinguishing nozzle-head, each of said fire extinguishing nozzles including a nozzle aperture capable of independent production of a fluid mist when supplied under pressure with an extinguishing fluid;

at least one conduit for supplying the extinguishing fluid from a supply to the fire extinguishing nozzles; and a valve combination for selectively directly flow of the extinguishing fluid to desired ones of the fire extinguishing nozzles, wherein said at least one conduit includes a supply pipe disposed within the housing.

2. A fire extinguishing pistol according to claim 1, wherein said fire extinguishing nozzles include a central fire extinguishing nozzle disposed at a central position of the forward end of the fire extinguishing nozzle-head.

3. A fire extinguishing pistol according to claim 1, wherein the fire extinguishing nozzles include a first group of fire extinguishing nozzles, at least a portion of the first group of fire extinguishing nozzles being aligned along an arcuate locus.

4. A fire extinguishing pistol according to claim 1, wherein the fire extinguishing nozzles include a first group of fire extinguishing nozzles, at least a portion of the first group of fire extinguishing nozzles being aligned along an enclosed circular locus.

5. A fire extinguishing pistol according to claim 1, wherein the fire extinguishing nozzles include a first group of fire extinguishing nozzles, members of the first group of fire extinguishing nozzles being spaced apart an equal distance from one another.

6. A fire extinguishing pistol according to claim 1, further comprising a carrier unit interposed between the fire extinguishing nozzle-head and the housing, the fire extinguishing nozzle-head being detachably connected to the carrier unit.

7. A fire extinguishing pistol according to claim 1, wherein:

the fire extinguishing nozzle-head includes a front face and a planar section slanting backward from the front face at an angle relative thereto; and the fire extinguishing nozzles include a first group of fire extinguishing nozzles mounted on the planar section.

8. A fire extinguishing pistol according to claim 1, wherein:

the fire extinguishing nozzle-head includes a lateral area; and the fire extinguishing nozzles include at least one laterally-disposed fire extinguishing nozzle mounted on the lateral area.

9. A fire extinguishing pistol according to claim 7, wherein:

the fire extinguishing nozzle-head includes a lateral area; and the fire extinguishing nozzles include a second group of fire extinguishing nozzles mounted on the lateral area, members of the second group of fire extinguishing nozzles being spaced apart an equal distance from one another.

10. A nozzle assembly for use with a transportable fire extinguishing pistol, comprising:

a fire extinguishing nozzle-head;

fire extinguishing nozzles mounted on said fire extinguishing nozzle-head in spaced apart positions at a forward end of the fire extinguishing nozzle-head, each of said fire extinguishing nozzles being connectable to a supply of extinguishing fluid and including a nozzle aperture capable of independent production of a fluid mist when supplied under pressure with the extinguishing fluid; and a valve combination for selectively directing flow of the extinguishing fluid to desired ones of the fire extinguishing nozzles, the fire extinguishing nozzle-head includes a front face, and a planar section slanting backward from the front face at an angle relative thereto; and the fire extinguishing nozzles including a central fire extinguishing nozzle disposed centrally of the fron face, and a first group of fire extinguishing nozzles disposed on the planar section.

11. A nozzle assembly for use with a transportable fire extinguishing pistol, comprising;

a fire extinguishing nozzle-head;

fire extinguishing nozzles mounted on said fire extinguishing nozzle-head in spaced apart positions at a forward end of the fire extinguishing nozzle-head, each of said fire extinguishing nozzles being connectable to a supply of extinguishing fluid and including a nozzle aperature capable of independent production of a fluid mist when supplied under pressure with the extinguishing fluid;

a valve combination for selectively directly flow of the extinguishing fluid to desired ones of the fire extinguishing nozzles;

the fire extinguishing nozzle-head including a front face, and a planar section slanting backward from the front face at an angle relative thereto;

the fire extinguishing nozzles including a central fire extinguishing nozzle disposed centrally of the front face, and a first group of fire extinguishing nozzles disposed on the planar section;

the fire extiguishing nozzle-head further including a lateral area joining the planar section; and the fire extinguishing nozzles further including a second group of fire extinguishing nozzles disposed in the lateral area.

12. A nozzle assembly according to claim 11, wherein the valve combination selectively directs flow of the extinguishing fluid to one or a combination of the central fire extinguising nozzle, the first group of fire extinguishing nozzles and the second group of fire extinguishing nozzles.

13. A nozzle assembly according to claim 11, further comprising:

a first supply pipe, a second supply pipe and a third supply pipe for conducing the extinguishing fluid from the supply to the central fire extinguishing nozzle, the first group of fire extinguishing nozzles and the second group of fire extinguishing nozzles, respectively; and the valve combination including a mechanism for selectively connecting one or a combination of the first, second and third supply pipes to the supply.

* * * * *